US008857926B2

(12) United States Patent
Toro

(10) Patent No.: US 8,857,926 B2
(45) Date of Patent: Oct. 14, 2014

(54) DECK STORAGE BIN SYSTEM

(75) Inventor: Joseph Toro, Port Jefferson Station, NY (US)

(73) Assignee: AZEK Building Products, Inc., Scranton, PA (US)

( * ) Notice: Subject to any disclaimer, the term of this patent is extended or adjusted under 35 U.S.C. 154(b) by 183 days.

(21) Appl. No.: 13/347,002

(22) Filed: Jan. 10, 2012

(65) Prior Publication Data

US 2012/0175369 A1 Jul. 12, 2012

Related U.S. Application Data

(60) Provisional application No. 61/431,607, filed on Jan. 11, 2011.

(51) Int. Cl.
*A47B 67/02* (2006.01)
*A47B 37/00* (2006.01)

(52) U.S. Cl.
CPC ..... *A47B 37/00* (2013.01)
USPC ..... 312/242

(58) Field of Classification Search
USPC ..... 312/242, 100–102, 245–248, 237; 52/45.01
See application file for complete search history.

(56) References Cited

U.S. PATENT DOCUMENTS

| | | | | |
|---|---|---|---|---|
| 622,284 | A * | 4/1899 | Snyder | 312/242 |
| 5,975,002 | A | 11/1999 | Rieger | |
| 6,202,359 | B1 * | 3/2001 | Reed | 52/31 |
| 6,415,733 | B1 | 7/2002 | Hudson et al. | |
| 6,848,226 | B1 * | 2/2005 | Boyd et al. | 52/220.8 |
| 7,726,080 | B2 | 6/2010 | Hyndman | |
| 2006/0043741 | A1 | 3/2006 | Hopper et al. | |
| 2009/0114689 | A1 | 5/2009 | Hord et al. | |
| 2010/0275528 | A1 | 11/2010 | Andrews | |
| 2011/0030308 | A1 * | 2/2011 | Keenan | 52/745.01 |

FOREIGN PATENT DOCUMENTS

| | | | |
|---|---|---|---|
| DE | 29906036 U1 | | 6/1999 |
| JP | 11311018 | * | 11/1999 |
| JP | 200208199 | * | 3/2002 |
| JP | 2002089030 | * | 3/2002 |
| JP | 2003064862 | * | 3/2003 |
| JP | 2004169284 | * | 6/2004 |
| JP | 2007120158 | * | 5/2007 |

* cited by examiner

*Primary Examiner* — Darnell Jayne
*Assistant Examiner* — Timothy M Ayres
(74) *Attorney, Agent, or Firm* — Buchanan Ingersoll & Rooney PC

(57) ABSTRACT

A deck storage bin system has a hatch, a deck frame assembly that has an outer lip and an inner lip, a storage tub having a bottom surface, and at least one inner support. The hatch is moveable between the closed position and an open position. The outer lip of the deck frame is configured to engage a perimeter of a predefined aperture in a floor surface of a deck such that a portion of the deck frame assembly extends into the predefined aperture. The inner lip defines an opening and the inner lip is sized and configured to support the hatch when the hatch is in a closed position. The storage tub extends below the opening defined by the inner lip of the deck frame and is attached to the at least one inner support.

20 Claims, 5 Drawing Sheets

DECK STORAGE BIN SYSTEM

CROSS REFERENCE TO RELATED APPLICATION

This application claims the benefit of provisional application Ser. No. 61/431,607, filed Jan. 11, 2011.

BACKGROUND OF THE INVENTION

1. Field of the Invention

The present invention relates to improvements in storage systems. More particularly the invention relates to an easy to assemble deck storage bin system.

2. Description of the Related Art

Many buildings have outdoor decks. Owners of decks may desire to have outdoor storage in a location that is close to the location of the deck. In many cases, this requires a bench with a hinged seat that allows access to the storage within the bench.

However, a deck may not have originally been built with a bench or a bench storage unit may not provide enough storage room. Additionally, if a deck does not have a bench or a bench that is large enough to provide the necessary amount of storage, a storage unit may require extensive construction that an owner is not capable of undertaking or performing to a level such that the deck retains its aesthetic appearance. Furthermore, constructing a bench storage system may take up too much of the existing surface area of the deck and the associated expenditure may be too great to justify the construction.

Thus there is a need for a deck storage bin system that is easy to manufacture and install, and has an aesthetically pleasing appearance.

SUMMARY OF THE INVENTION

A deck storage bin system is disclosed herein that comprises a hatch that is moveable between a closed position and an open position via a mounting structure, a deck frame assembly having an outer lip and an inner lip, a storage tub having a bottom surface, and at least one inner support to which the storage tub is attached. The outer lip is configured to engage a perimeter of a predefined aperture in a floor surface of a deck such that a portion of the deck frame assembly extends into the predefined aperture. The inner lip defines an opening and the inner lip is sized and configured to support the hatch when the hatch is in the closed position. Further the storage tub extends below the opening defined by the inner lip of the deck frame assembly.

In a preferred embodiment of the deck storage bin system, the hatch comprises a cover subassembly that has a top surface and a plurality of cross members, a rain cover that is sized and configured to fit over the top surface of the cover subassembly and a cover trim ring sized and configured to fit over the cover subassembly and rain cover.

In another preferred embodiment of the deck storage bin system, the cover trim ring has an inner cover trim ring that is sized and configured to hold a plurality of boards that are placed between the rain cover and the cover trim ring.

In a further preferred embodiment of the deck storage bin system, the at least one inner support has a first shape and the storage tub is sized and configured to fit within the first shape.

In yet another preferred embodiment of the deck storage bin system, the storage tub has at least one channel defined in the bottom surface such that the least one inner support fits into and engages the at least one channel.

In still another preferred embodiment of the deck storage bin system, the inner lip of the deck frame assembly engages the hatch such that the inner lip contacts the hatch inside a perimeter of the hatch.

In yet a further preferred embodiment of the deck storage bin system, the inner lip comprises an annular channel around an inside perimeter of the deck frame assembly.

In another preferred embodiment of the deck storage bin system, the inner lip comprises at least one drain hole in the annular channel.

In a further preferred embodiment of the deck storage bin system, the at least one inner support comprises a tubular extrusion.

In yet another preferred embodiment of the deck storage bin system, the hatch is attached to the deck frame assembly via the mounting structure, such that the hatch is moveable between the closed position and the open position.

In still another preferred embodiment of the deck storage bin system, the mounting structure comprises at least one gas spring and a plurality of hinges that attach the hatch to the deck frame assembly.

In yet a further preferred embodiment of the deck storage bin system, the deck frame assembly comprises an aluminum extrusion.

In another preferred embodiment of the deck storage bin system, the opening defined by the inner lip is sized and configured to allow the storage tub to pass through the opening.

Further disclosed herein is a kit for an deck storage bin system that comprises a hatch, a mounting structure for the hatch, a storage tub having a bottom surface, at least one inner support, and a deck frame assembly having an outer lip and an inner lip. The outer lip is sized and configured to engage a perimeter of a predefined aperture in a floor surface such that a portion of the deck frame assembly will extend into the predefined aperture. The inner lip defines an opening and the inner lip is sized and configured to support the hatch. The inner lip is also sized and configured to be located within the predefined aperture and below the floor surface. Further, the at least one inner support is sized and configured to be mounted within the predefined aperture and to extend away from the floor surface.

In yet another preferred embodiment of the kit, the hatch comprises a cover subassembly that has a top surface and a plurality of cross members, a rain cover that is sized and configured to fit over the top surface of the cover subassembly, and a cover trim ring that is sized and configured to fit over the cover subassembly and rain cover.

In another preferred embodiment of the kit, the cover trim ring has an inner cover trim ring that is sized and configured to hold a plurality of boards that are placed between the rain cover and the cover trim ring.

In yet another preferred embodiment of the kit, the deck frame assembly comprises an aluminum extrusion.

In still another preferred embodiment of the kit, the mounting structure comprises a spring mechanism sized and configured to be attached to the hatch to hold the hatch in the open position and the closed position.

In a further preferred embodiment of the deck storage bin system, the mounting structure comprises at least one gas spring and a plurality of hinges and the at least one gas spring and the plurality of hinges that are sized and configured to attach the hatch to the deck frame assembly.

In yet a further preferred embodiment of the deck storage bin system, the kit further comprises a handle that is sized and configured to be attached to the hatch.

Other details, objects, and advantages of the invention will become apparent as the following description of certain present preferred embodiments thereof proceeds.

BRIEF DESCRIPTION OF THE FIGURES

In the accompanying drawing I have shown certain present preferred embodiments of my deck storage bin system in which.

DESCRIPTION OF THE PREFERRED EMBODIMENTS

Figure 6:
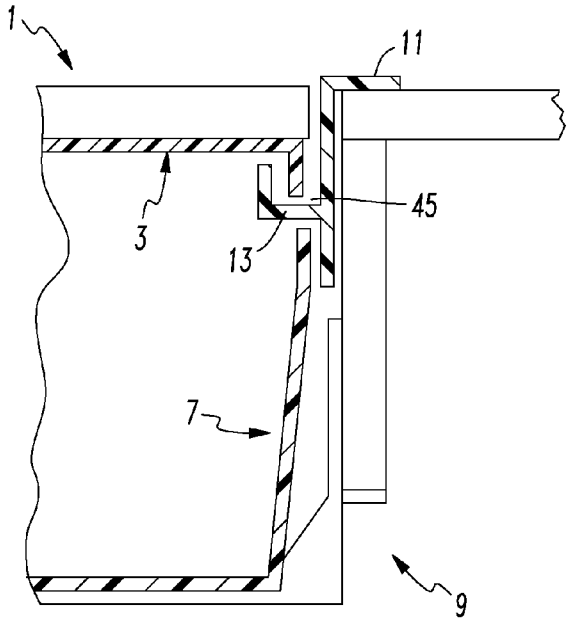
FIG. 6 is a cross section view of a portion of another preferred embodiment of my deck storage bin system.
Figure 5:
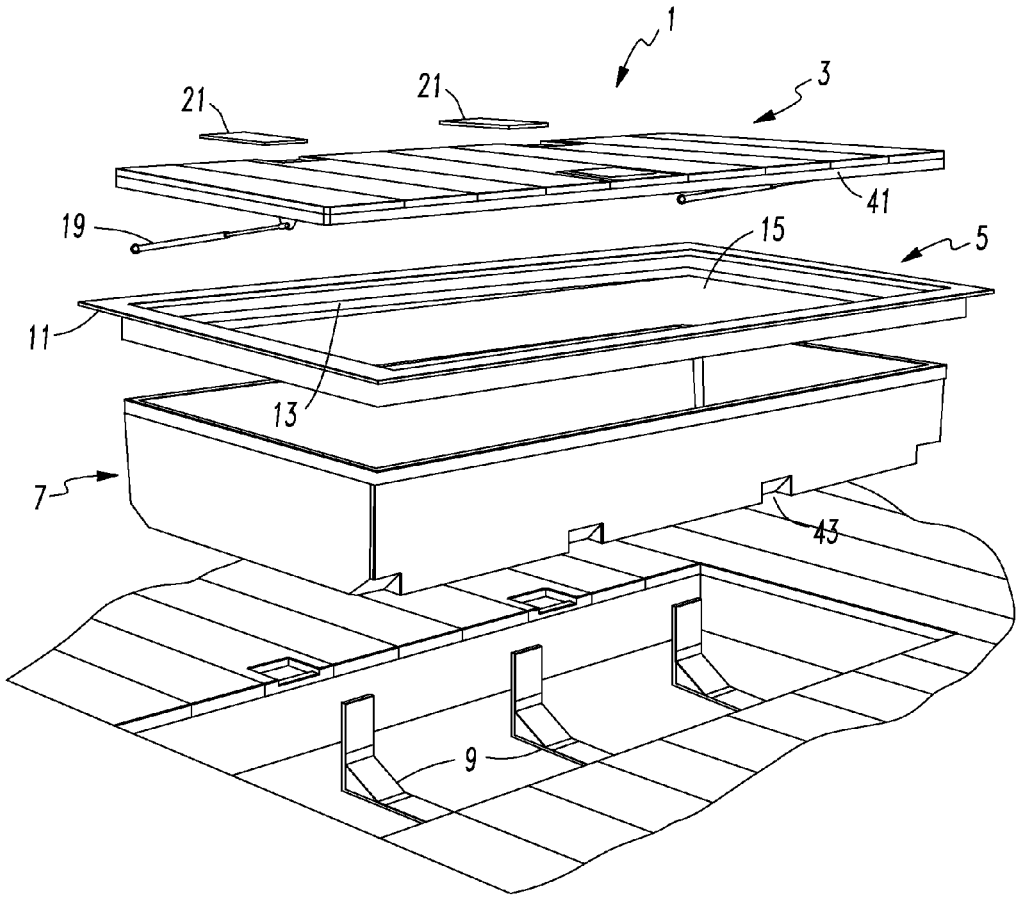
FIG. 5 is an exploded view of another present preferred embodiment of my deck storage bin system.

Referring to the preferred embodiment shown in FIGS. 1-6, my deck storage bin system 1 comprises a hatch 3, a deck frame assembly 5, a storage tub 7, and at least one inner support 9 to which the storage tub 7 may be attached. The deck frame assembly 5 has an outer lip 11 and an inner lip 13. The hatch 3 is attached to the deck frame assembly 5 such that the hatch 3 is moveable between the closed position, as shown in FIGS. 3*b*, 5, and 6, and an open position, as shown in FIG. 3*a*. Additionally, the outer lip 11 is configured to engage a perimeter of a predefined aperture in a floor surface of a deck such that a portion of the deck frame assembly 5 extends into the predefined aperture. The inner lip 13 of the deck frame assembly 5 defines an opening 15 and is sized and configured to support the hatch 3 when the hatch 3 is in the closed position. The opening 15 defined by the inner lip may be sized and configured to allow the storage tub 7 to pass through the opening 15.

Additionally, the at least one inner support 9 is sized and configured to be mounted within the predefined aperture and to extend away from the floor surface. The storage tub 7 has a bottom surface 17 and the storage tub 7 extends below the opening 17 defined by the inner lip 13 of the deck frame assembly 5. The bottom surface 17 of the storage tub 7 may be supported by the at least one inner support 9.

Further, the deck frame assembly 5 may comprise a second inner lip 23 located below the inner lip 13. The second inner lip 23 may define an opening that is smaller than the opening 15 defined by the inner lip 13. The second inner lip 23 may engage a lip 25 of the storage bin 7 such that the storage bin cannot pass through the opening defined by the second inner lip 23.

Figure 1:
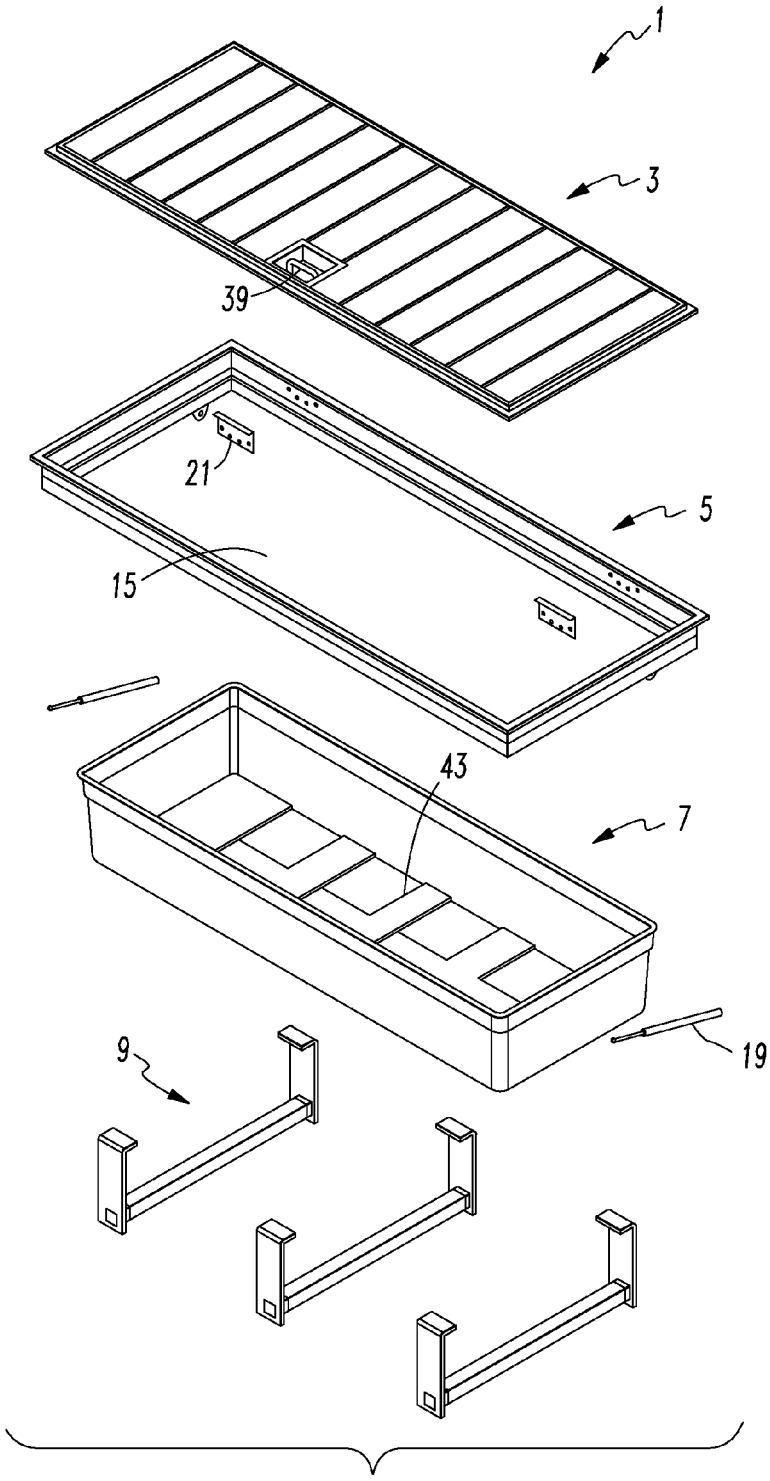
FIG. 1 is an exploded view of a present preferred embodiment of my deck storage bin system.
Figure 3A:
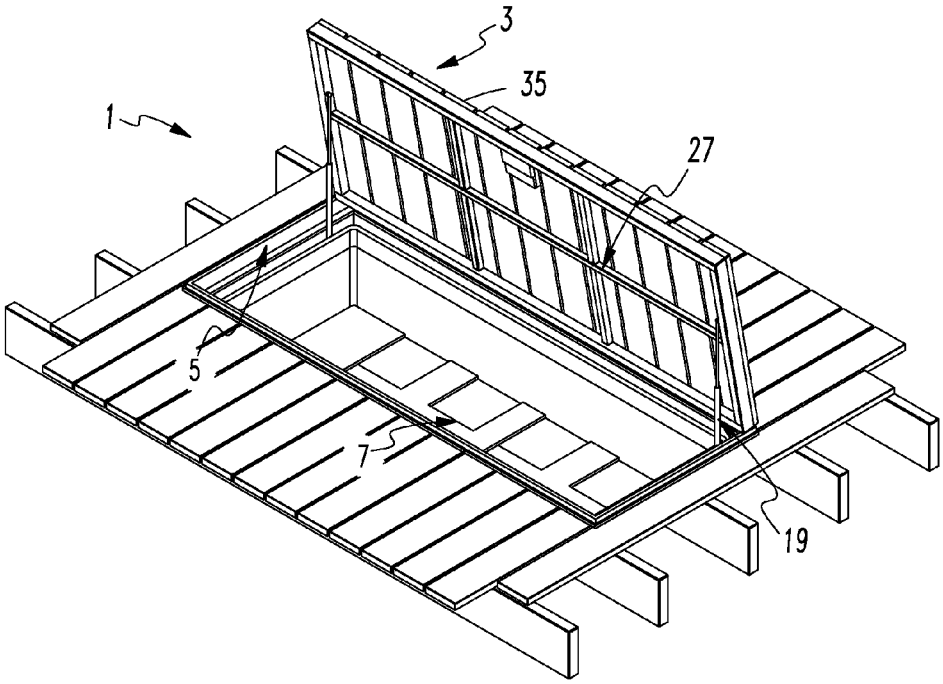
FIG. 3*a* is a perspective view of the present preferred embodiment of my deck storage bin system shown in FIG. 1 with the hatch in the open position.

The deck storage bin system 1 also includes a mounting structure that comprises a spring mechanism 19 and a plurality of hinges 21 attached to the hatch 3 and the deck frame assembly 5 to hold the hatch 3 in the open position and the closed position. In another embodiment, the spring mechanism 19 and/or the hinges may be attached to the deck and not the deck frame assembly. The spring mechanism 19 may include for example, at least one gas spring, as shown in FIGS. 1, 3*a*, and 5. One of ordinary skill would under that the mounting structure may comprise other variations, for example a folding hinge with a coil spring that attaches the hatch to the deck frame assembly.

Figure 2:
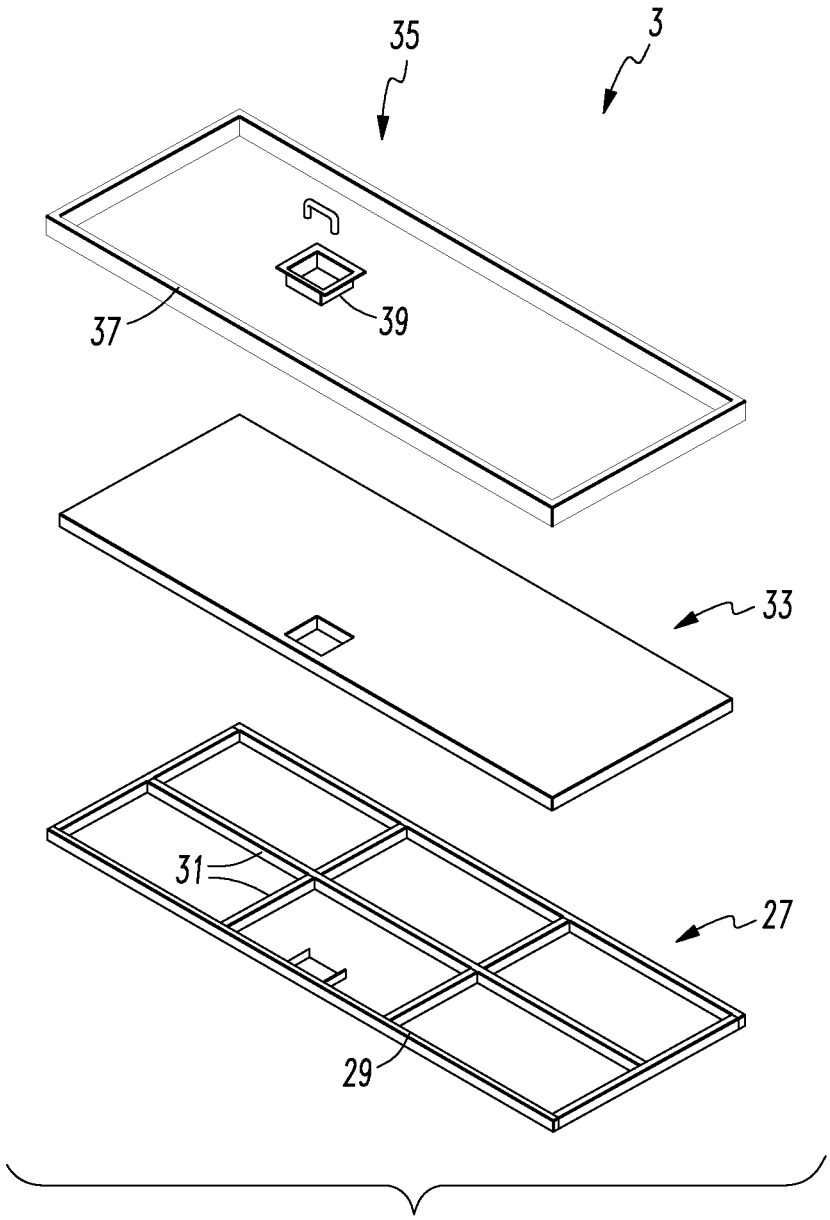
FIG. 2 is an exploded view of a present preferred embodiment of a hatch subassembly of my deck storage bin system.
Figure 3B:
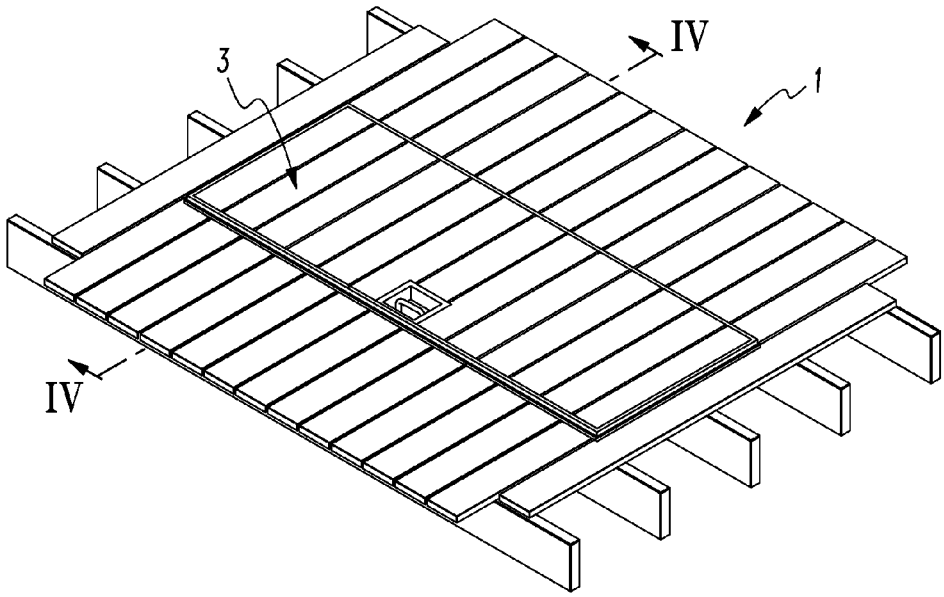
FIG. 3*b* is a perspective view of the present preferred embodiment of my deck storage bin system shown in FIG. 1 with the hatch in the closed position.
Figure 4:
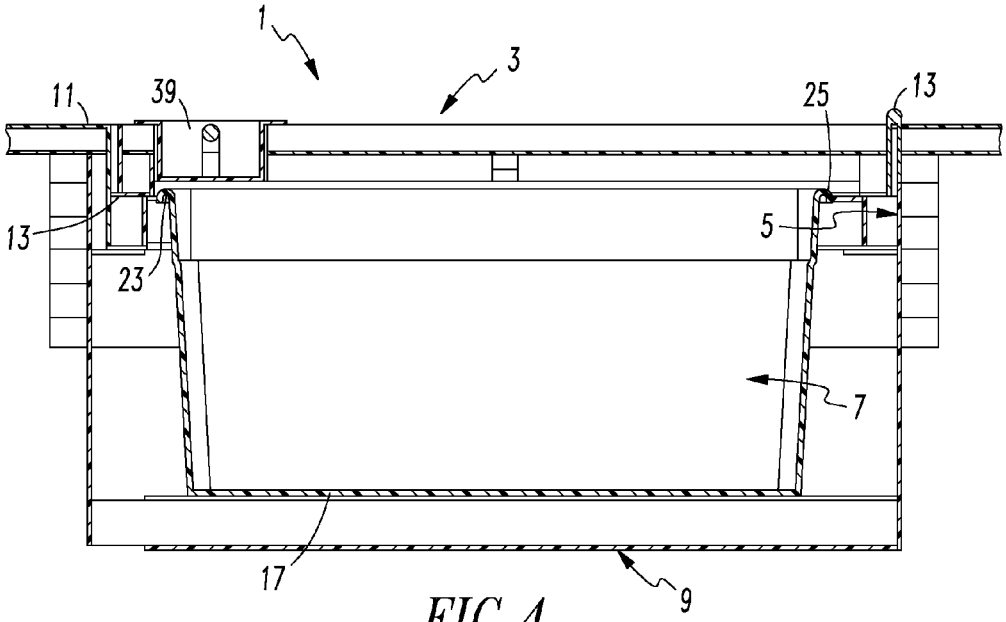
FIG. 4 is a cross section view of the present preferred embodiment of my deck storage bin system shown in FIG. 3*b* along the line IV-IV.

In the preferred embodiment shown in FIG. 2, the hatch 3 comprises a hatch subassembly that includes a cover subassembly 27 having a top surface 29 and a plurality of cross members 31, a rain cover 33 that is sized and configured to fit over the top surface 29, and a cover trim ring 35 sized and configured to fit over the cover subassembly 27 and rain cover 33. The rain cover may be a transparent, opaque, or translucent material. The cover trim ring may include a handle and a mounting 39. As shown in FIG. 2, the cover trim ring 35 may have an inner cover trim ring 37. The inner cover trim ring 37 is sized and configured to hold an outward facing surface such as a plurality of boards that are placed between the rain cover 33 and the cover trim ring 35 as shown in FIGS. 3*a* and 3*b*. This allows the hatch to have an appearance similar to that of a surrounding deck surface.

However, the hatch 3 may comprise a single piece structure 41. As shown in FIG. 5, the hatch 3 may also be made such that boards can be fastened to a single piece structure 41 without the need for a cover trim ring in order to blend in with a deck surface.

The at least one inner support 9 may have a first shape and the storage tub 7 may be appropriately sized and configured to fit within the first shape of the at least one inner support 9 such that the at least one inner support cradles the storage tub 7. The first shape may be for example a square, a rectangle, or a triangle, and may add extra support to the sides of the storage tub 7 to prevent deflection or warping of the storage tub 7. One of ordinary skill would understand that the shape of the at least one inner support 9 and a corresponding shape of the storage tub 7 may vary. In addition, as shown in FIGS. 1 and 5, the storage tub may have at least one channel 43 defined in the bottom surface 17 such that the least one inner support 9 fits into and engages the at least one channel 43.

To keep rain and moisture out of the storage tub 7, the inner lip 13 of the deck frame assembly 5 may be designed to engage the hatch such that the inner lip 13 contacts the hatch 3 inside a perimeter of the hatch 3. The inner lip 13 of the deck frame assembly 5 may include a gasket or thin layer of insulation to further improve a seal between the hatch 3 and the deck frame assembly 5. In addition, as shown in FIG. 6, the inner lip may comprise an annular channel 45 around an inside perimeter of the deck frame assembly 5. The inner lip 13 may have at least one drain hole in the annular channel 45 to allow for water to be directed away from going into the storage bin 7.

Portions of the deck storage bin system may be made as extrusions. For example, the deck frame assembly, the at least one inner support, the cover frame subassembly, and the cover trim ring may be manufactured as an extrusion. The extrusion may be or example, from aluminum or other suitable material, such as plastic or fiberglass. Further, portions of either the deck frame assembly or the at least one inner support may comprise a tubular extrusion.

The deck storage bin system may also be provided as components in a kit. The kit may include a hatch, a mounting structure for the hatch, a storage tub, at least one inner support, and a deck frame assembly. Further, the hatch may be provided separately or with the other components and include a cover subassembly, a rain cover, a cover trim ring, and a handle and associated mounting. Alternatively, the kit may include only the frame for the hatch subassembly such that the purchaser can make the hatch using the same boards as were used to build the deck.

While I have shown and described certain present preferred embodiments of my deck storage bin system and have illustrated certain present preferred methods of making and using the same, it is to be distinctly understood that the invention is not limited thereto but may be otherwise variously embodied and practiced within the scope of the following claims.

I claim:

1. A deck storage bin system comprising:

a hatch being moveable between a closed position and an open position via a mounting structure;

a deck frame assembly having an outer lip and an inner lip, the outer lip configured to engage a perimeter of a predefined aperture in a floor surface of a deck such that a portion of the deck frame assembly extends into the predefined aperture, the deck frame assembly defining an opening, the inner lip being sized and configured to support the hatch when the hatch is in the closed position;

a storage tub within the opening, the storage tub having a bottom surface that is located below the opening; and at least one inner support, wherein the at least one inner support and the storage tub are each sized and configured such that the bottom surface of the storage tub rests on and is supported by the at least one inner support and such that the inner support is underneath the bottom surface.

2. The deck storage bin system of claim 1 wherein the hatch comprises:

a cover subassembly having a top surface and a plurality of cross members;

a rain cover being sized and configured to fit over the top surface of the cover subassembly; and a cover trim ring sized and configured to fit over the cover subassembly and rain cover.

3. The deck storage bin system of claim 2 wherein the cover trim ring has an inner cover trim ring that is sized and configured to hold a plurality of boards that are placed between the rain cover and the cover trim ring.

4. The deck storage bin system of claim 1 wherein the at least one inner support has a first shape, and wherein the storage tub is sized and configured to fit within the first shape.

5. The deck storage bin system of claim 1 wherein the inner lip of the deck frame assembly engages the hatch such that the inner lip contacts the hatch inside a perimeter of the hatch.

6. The deck storage bin system of claim 1 wherein the inner lip comprises an annular channel around an inside perimeter of the deck frame assembly.

7. The deck storage bin system of claim 6 wherein the inner lip comprises at least one drain hole in the annular channel.

8. The deck storage bin system of claim 1 wherein the at least one inner support comprises a tubular extrusion.

9. The deck storage bin system of claim 1 wherein the hatch is attached to the deck frame assembly via the mounting structure such that the hatch is moveable between the closed position and the open position.

10. The deck storage bin system of claim 9 wherein the mounting structure comprises at least one gas spring and a plurality of hinges which attach the hatch to the deck frame assembly.

11. The deck storage bin system of claim 1 wherein the deck frame assembly comprises an aluminum extrusion.

12. The deck storage bin system of claim 1 wherein the opening defined by the inner lip is sized and configured to allow the storage tub to pass through the opening.

13. A deck storage bin system comprising:

a hatch being moveable between a closed position and an open position via a mounting structure;

a deck frame assembly having an outer lip and an inner lip, the outer lip configured to engage a perimeter of a predefined aperture in a floor surface of a deck such that a portion of the deck frame assembly extends into the predefined aperture, the inner lip defining an opening, the inner lip being sized and configured to support the hatch when the hatch is in the closed position;

a storage tub having a bottom surface and extending below the opening defined by the inner lip of the deck frame assembly; and at least one inner support to which the storage tub is attached; and wherein the storage tub has at least one channel defined in the bottom surface such that the least one inner support fits into and engages the at least one channel.

14. A kit for a deck storage bin system comprising:

a hatch subassembly sized and configured to receive a plurality of boards;

a mounting structure for the hatch;

a storage tub having a bottom surface;

at least one inner support;

a deck frame assembly having an outer lip and an inner lip, the outer lip sized and configured to engage a perimeter of a predefined aperture in a floor surface such that a portion of the deck frame assembly will extend into the predefined aperture, the deck frame assembly defining an opening, and the inner lip being sized and configured to support the hatch and to be located within the predefined aperture and below the floor surface; and wherein the at least one inner support is sized and configured to be mounted within the predefined aperture and to extend away from the floor surface; and wherein the storage tub is within the opening and the bottom surface of the storage tub is located below the opening; and wherein the at least one inner support and the storage tub are each sized and configured such that the bottom surface of the storage tub rests on and is supported by the at least one inner support and such that the inner support is underneath the bottom surface.

15. The kit of claim 14 wherein the hatch subassembly comprises:

a cover subassembly having a top surface and a plurality of cross members;

a rain cover being sized and configured to fit over the top surface of the cover subassembly; and a cover trim ring sized and configured to fit over the cover subassembly and rain cover.

16. The kit of claim 15 wherein the cover trim ring has an inner cover trim ring that is sized and configured to hold a plurality of boards that are placed between the rain cover and the cover trim ring.

17. The kit of claim 14 wherein the deck frame assembly comprises an aluminum extrusion.

18. The kit of claim 14 wherein the mounting structure comprises a spring mechanism that is sized and configured to attach the hatch to the deck frame assembly and to hold the hatch in an open position and a closed position.

19. The kit of claim 14 wherein the mounting structure comprises at least one gas spring and a plurality of hinges, wherein the at least one gas spring and the plurality of hinges are sized and configured to attach the hatch to the deck frame assembly and to hold the hatch in an open position and a closed position.

20. The kit of claim 14 further comprising a handle that is sized and configured to be attached to the hatch.

* * * * *